US012000072B2

(12) United States Patent
Scheckelhoff

(10) Patent No.: US 12,000,072 B2
(45) Date of Patent: Jun. 4, 2024

(54) RESPONSIVE SOAK TIME IN A WASHING MACHINE APPLIANCE

(71) Applicant: Haier US Appliance Solutions, Inc., Wilmington, DE (US)

(72) Inventor: Ryan James Scheckelhoff, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 144 days.

(21) Appl. No.: 17/497,276

(22) Filed: Oct. 8, 2021

(65) Prior Publication Data

US 2023/0109803 A1 Apr. 13, 2023

(51) Int. Cl.

| | |
|---|---|
| ***D06F 33/44*** | (2020.01) |
| ***D06F 33/34*** | (2020.01) |
| ***D06F 33/54*** | (2020.01) |
| *D06F 101/14* | (2020.01) |
| *D06F 103/02* | (2020.01) |
| *D06F 103/16* | (2020.01) |
| *D06F 103/20* | (2020.01) |
| *D06F 105/02* | (2020.01) |
| *D06F 105/52* | (2020.01) |
| *D06F 105/62* | (2020.01) |

(52) U.S. Cl.

CPC ..... *D06F 33/44* (2020.02); *D06F 33/34* (2020.02); *D06F 33/54* (2020.02); *D06F 2101/14* (2020.02); *D06F 2103/02* (2020.02); *D06F 2103/16* (2020.02); *D06F 2103/20* (2020.02); *D06F 2105/02* (2020.02); *D06F 2105/52* (2020.02); *D06F 2105/62* (2020.02)

(58) Field of Classification Search

CPC ..... D06F 2101/14; D06F 33/44; D06F 33/34; D06F 33/54; D06F 34/28

See application file for complete search history.

(56) References Cited

U.S. PATENT DOCUMENTS

| | | | | |
|---|---|---|---|---|
| 2003/0154560 | A1* | 8/2003 | Behrens | D06F 34/28 68/12.12 |
| 2019/0177897 | A1* | 6/2019 | Damtew | D06F 37/40 |

FOREIGN PATENT DOCUMENTS

| | | | | |
|---|---|---|---|---|
| JP | H06335591 | A | 12/1994 | |
| KR | 20200085613 | A | 1/2019 | |
| WO | WO-2015189743 | A1 * | 12/2015 | D06F 39/005 |

* cited by examiner

*Primary Examiner* — Joseph L. Perrin
*Assistant Examiner* — Kevin G Lee
(74) *Attorney, Agent, or Firm* — Dority & Manning, P.A.

(57) ABSTRACT

A method of operating a washing machine appliance includes filling a wash tub with a wash liquid during a first cycle. The method also includes receiving a pause input after filling the wash tub and before draining the wash tub during the first cycle. In response to the pause input, the first cycle is paused for a pause duration. The method further includes incrementing a pause counter in response to the pause input and storing the pause duration after pausing the first cycle. The method also includes filling the wash tub with a wash liquid during a second cycle after the first cycle and automatically pausing the second cycle after filling the wash tub with the wash liquid during the second cycle, based on the pause counter and the stored pause duration.

20 Claims, 4 Drawing Sheets

RESPONSIVE SOAK TIME IN A WASHING MACHINE APPLIANCE

FIELD OF THE INVENTION

The present subject matter relates generally to washing machine appliances, and more particularly to methods for operating washing machine appliances, and washing machine appliances that perform such methods.

BACKGROUND OF THE INVENTION

Washing machine appliances generally include a tub for containing wash liquid, e.g., water, detergent, and/or bleach, during operation of such washing machine appliances. A wash basket is rotatably mounted within the wash tub and defines a wash chamber for receipt of articles for washing, and an agitation element is rotatably mounted within the wash basket. Washing machine appliances are typically equipped to operate in one or more modes or cycles, such as wash, rinse, and spin cycles. For example, during a wash or rinse cycle, the wash fluid is directed into the wash tub in order to wash and/or rinse articles within the wash chamber. In addition, the wash basket and/or the agitation element can rotate at various speeds to agitate or impart motion to articles within the wash chamber, to wring wash fluid from articles within the wash chamber, etc.

Such cycles of a washing machine generally include a soak time, during which the wash tub is filled with liquid (e.g., water and/or detergent or other additives) and the liquid is retained in the tub. Thus, articles in the tub are allowed to soak, e.g., to help loosen or pre-treat soil, stains, etc. on the articles for the duration of the soak time. Standardized soak times, however, may not be optimal for all users and all loads. For example, some users may desire a different, e.g., longer, soak time depending on factors such as the soil level of the articles, water quality (e.g., hardness), and/or the particular additives used.

Accordingly, a washing machine appliance including features and control algorithms for providing an improved, e.g., more customized or user-responsive, soak time would be useful.

BRIEF DESCRIPTION OF THE INVENTION

Aspects and advantages of the invention will be set forth in part in the following description, or may be apparent from the description, or may be learned through practice of the invention.

In one exemplary embodiment, a method of operating a washing machine appliance is provided. The washing machine appliance includes a cabinet and a wash tub mounted within the cabinet. The wash tub is configured for containing fluid during operation of the washing machine appliance. The method includes filling the wash tub with a wash liquid during a first cycle of the washing machine appliance and receiving a pause input from a user interface of the washing machine appliance. The pause input is received after filling the wash tub with the wash liquid during the first cycle and before draining the wash liquid from the wash tub during the first cycle. The method also includes pausing the first cycle of the washing machine appliance for a pause duration in response to the pause input. The method further includes incrementing a pause counter in response to the pause input. After pausing the first cycle of the washing machine appliance, the pause duration is stored. The method also includes filling the wash tub with a wash liquid during a second cycle of the washing machine appliance after the first cycle and automatically pausing the second cycle of the washing machine appliance after filling the wash tub with the wash liquid during the second cycle, based on the pause counter and the stored pause duration.

In another exemplary embodiment, a washing machine appliance is provided. The washing machine appliance includes a cabinet with a wash tub mounted within the cabinet. The wash tub is configured for containing fluid during operation of the washing machine appliance. The washing machine appliance further includes a controller. The controller is configured for filling the wash tub with a wash liquid during a first cycle of the washing machine appliance and receiving a pause input from a user interface of the washing machine appliance. The pause input is received after filling the wash tub with the wash liquid during the first cycle and before draining the wash liquid from the wash tub during the first cycle. The controller is also configured for pausing the first cycle of the washing machine appliance for a pause duration in response to the pause input. The controller is further configured for incrementing a pause counter in response to the pause input. After pausing the first cycle of the washing machine appliance, the pause duration is stored. The controller is also configured for filling the wash tub with a wash liquid during a second cycle of the washing machine appliance after the first cycle and automatically pausing the second cycle of the washing machine appliance after filling the wash tub with the wash liquid during the second cycle, based on the pause counter and the stored pause duration.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
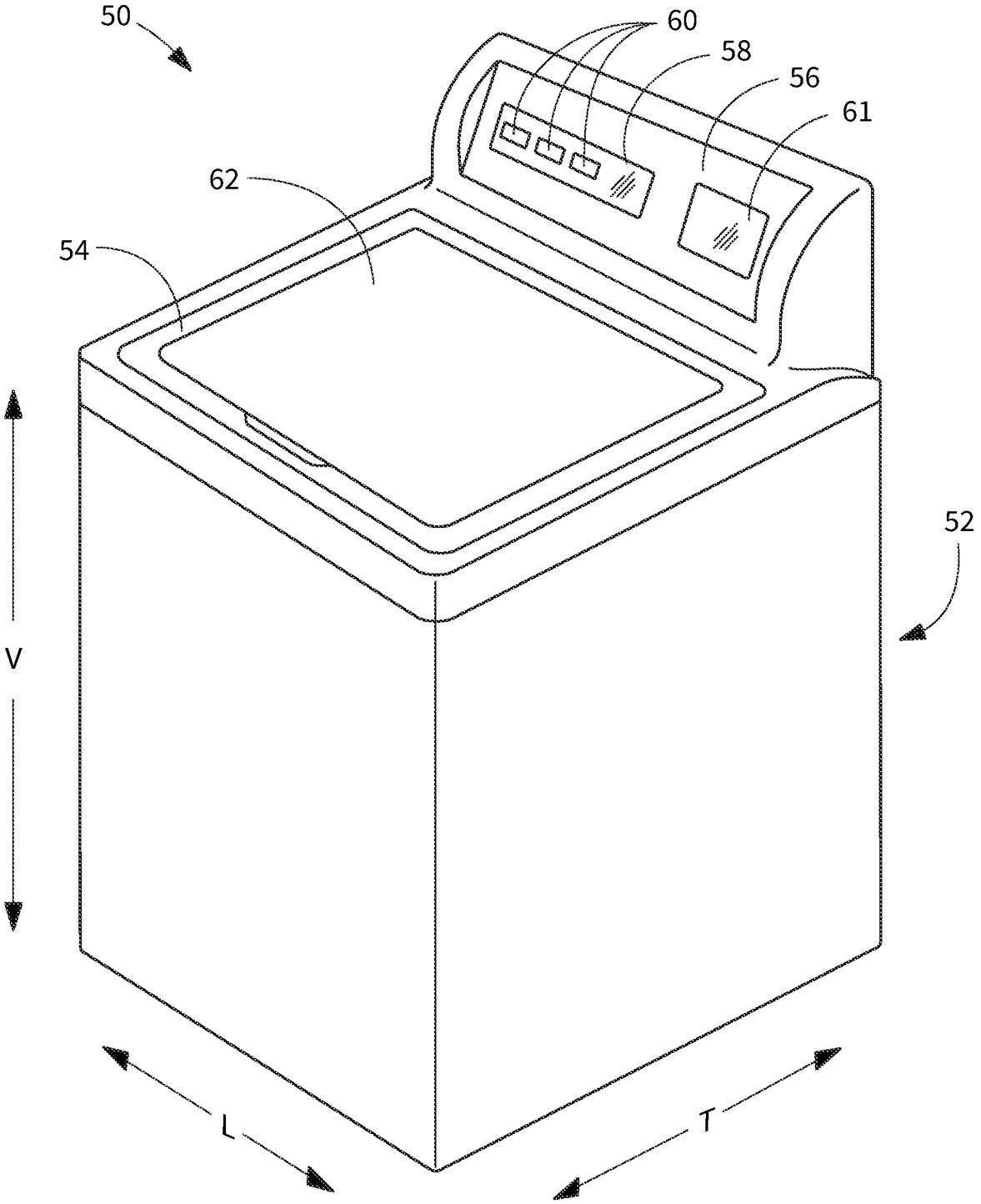
FIG. 1 provides a perspective view of a washing machine appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

As used herein, the terms "clothing" or "clothes" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance (e.g., clothes dryer) and may include a mixture of different or similar articles of clothing of different or similar types and kinds of fabrics, textiles, garments and linens within a particular laundering process.

FIG. 1 is a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface for operator selection of machine cycles and features, and in one embodiment, a display 61 indicates selected features, a countdown timer, and/or other items of interest to machine users. A lid 62 is mounted to cover 54 and is rotatable between an open position (not shown) facilitating access to a wash tub 64 (FIG. 2) located within cabinet 52 and a closed position (shown in FIG. 1) forming an enclosure over wash tub 64.

Figure 2:
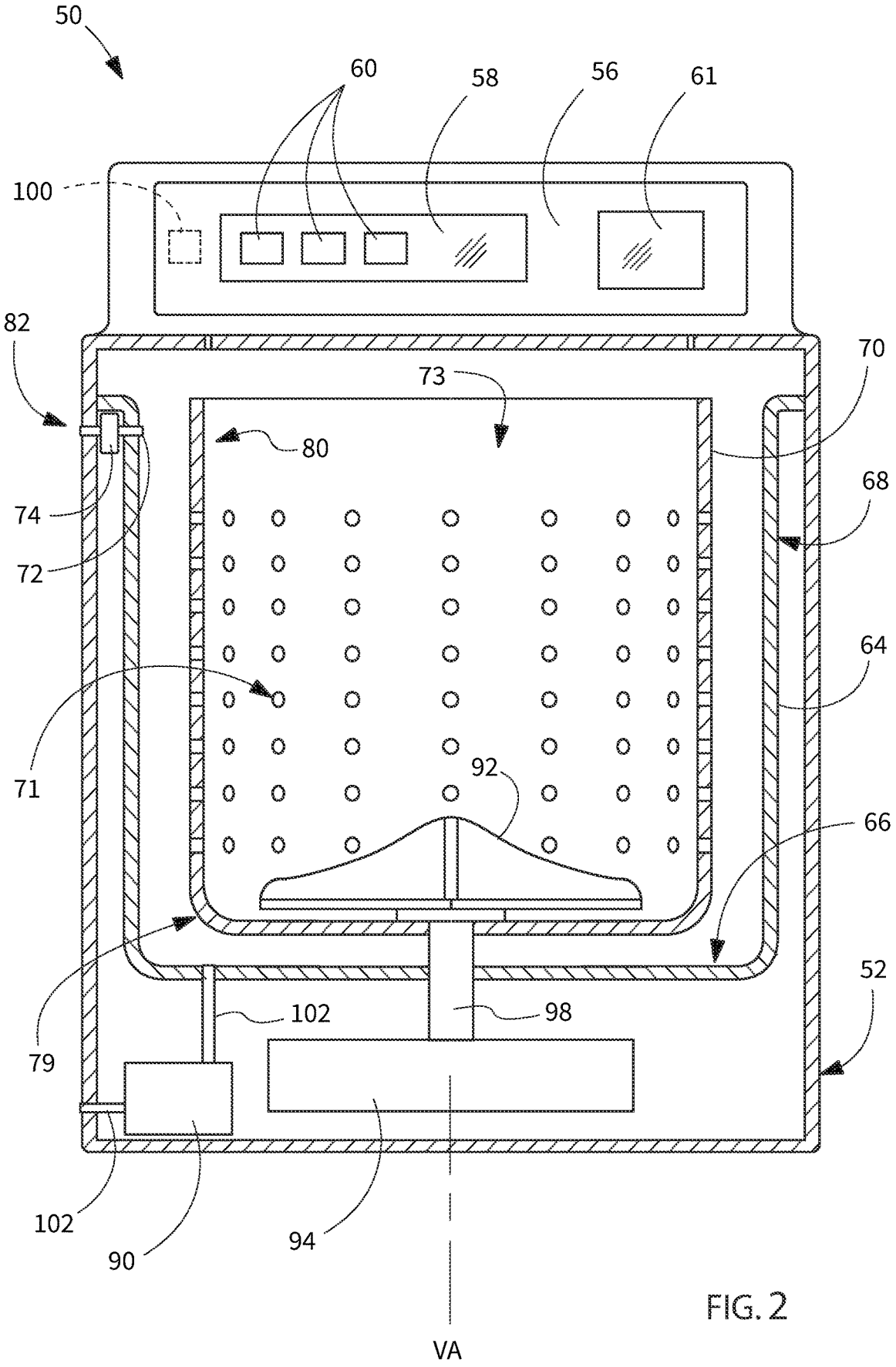
FIG. 2 provides a front, section view of the exemplary washing machine appliance of FIG. 1.

FIG. 2 provides a front, cross-section view of washing machine appliance 50. As used herein, terms such as "left" and "right" or "front" and "back" refer to directions from the perspective of a user facing the washing machine appliance 50 for accessing and/or operating the washing machine appliance 50. For example, a user stands in front of the washing machine appliance 50 to access door or lid 62 and/or inputs 60 (the door 62 and inputs 60 are described in more detail below). As may be seen in FIG. 2, wash tub 64 includes a bottom wall 66 and a sidewall 68. A wash basket 70 is rotatably mounted within wash tub 64. In particular, wash basket 70 is rotatable about a vertical axis VA. Thus, washing machine appliance is generally referred to as a vertical axis washing machine appliance. Wash basket 70 defines a wash chamber 73 for receipt of articles for washing and extends, e.g., vertically, between a bottom portion 79 and a top portion 80. Wash basket 70 includes a plurality of perforations 71 therein to facilitate fluid communication between an interior of wash basket 70 (e.g., the wash chamber 73 within the wash basket 70) and wash tub 64.

An inlet or spout 72 is configured for directing a flow of fluid into wash tub 64. The spout 72 may be a part of a fluid circulation system of the washing machine appliance, such as an inlet of the fluid circulation system. In particular, inlet 72 may be positioned at or adjacent top portion 80 of wash basket 70. Inlet 72 may be in fluid communication with a water supply (not shown) in order to direct fluid (e.g., clean water) into wash tub 64 and/or onto articles within wash chamber 73 of wash basket 70. A valve 74 regulates the flow of fluid through inlet 72. For example, valve 74 can selectively adjust to a closed position in order to terminate or obstruct the flow of fluid through inlet 72. In some embodiments, the inlet 72 may be or include a drawer, such as a detergent drawer or additive drawer, through which water flows before flowing into the wash tub 64 and/or wash chamber 73. For example, in embodiments which include the drawer, the water may mix with an additive in the drawer, thereby creating a wash liquid comprising the water and the additive dissolved therein or intermixed therewith, and the wash liquid may then flow into the wash chamber 73 via the inlet 72 (which may be at least partially defined by, e.g., a wall or other portion of the drawer in such embodiments) after a certain liquid volume or level within the drawer has been reached.

A pump assembly 90 (shown schematically in FIG. 2) is located beneath tub 64 and wash basket 70 for gravity assisted flow from wash tub 64. Pump 90 may be positioned along or in operative communication with a drain line 102 which provides fluid communication from the wash chamber 73 of the basket 70 to an external conduit, such as a wastewater line (not shown). In some embodiments, the pump 90 may also or instead be positioned along or in operative communication with a recirculation line (not shown) which extends back to the tub 64, e.g., in addition to the drain line 102.

An agitation element 92, shown as an impeller in FIG. 2, is disposed in wash basket 70 to impart an oscillatory motion to articles and liquid in wash chamber 73 of wash basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, single direction rotation at the other end). As illustrated in FIG. 2, agitation element 92 is oriented to rotate about vertical axis VA. Wash basket 70 and agitation element 92 are driven by a pancake motor 94. As motor output shaft 98 is rotated, wash basket 70 and agitation element 92 are operated for rotatable movement within wash tub 64, e.g., about vertical axis VA. Washing machine appliance 50 may also include a brake assembly (not shown) selectively applied or released for respectively maintaining wash basket 70 in a stationary position within wash tub 64 or for allowing wash basket 70 to spin within wash tub 64.

Operation of washing machine appliance 50 is controlled by a processing device or controller 100, that is operatively coupled to the user interface input located on washing machine backsplash 56 for user manipulation to select washing machine cycles and features. In response to user manipulation of the user interface input, controller 100 operates the various components of washing machine appliance 50 to execute selected machine cycles and features.

Controller 100 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 100 via one or more signal lines or shared communication busses. It should be noted that controllers 100 as disclosed herein are capable of and may be operable to perform any methods and associated method steps as disclosed herein.

In an illustrative embodiment, laundry items are loaded into wash chamber 73 of wash basket 70, and washing operation is initiated through operator manipulation of control input selectors 60. Wash tub 64 is filled with water and mixed with detergent to form a wash liquid. Valve 74 can be opened to initiate a flow of water into wash tub 64 via inlet 72, and wash tub 64 can be filled to the appropriate level for the amount of articles being washed. Once wash tub 64 is properly filled with wash fluid, the contents of the wash basket 70 are agitated with agitation element 92 for cleaning of laundry items in wash basket 70. More specifically, agitation element 92 may be moved back and forth in an oscillatory motion. The wash fluid may be recirculated through the washing machine appliance 50 at various points in the wash cycle, such as before or during the agitation phase (as well as one or more other portions of the wash cycle, separately or in addition to before and/or during the agitation phase).

After the agitation phase of the wash cycle is completed, wash tub 64 is drained. Laundry articles can then be rinsed by again adding fluid to wash tub 64, depending on the particulars of the cleaning cycle selected by a user, agitation element 92 may again provide agitation within wash basket 70. One or more spin cycles may also be used. In particular, a spin cycle may be applied after the wash cycle and/or after the rinse cycle in order to wring wash fluid from the articles being washed. During a spin cycle, wash basket 70 is rotated at relatively high speeds. In various embodiments, the pump 90 may be activated to drain liquid from the washing machine appliance 50 during the entire drain phase (or the entirety of each drain phase, e.g., between the wash and rinse and/or between the rinse and the spin) and may be activated during one or more portions of the spin cycle.

While described in the context of a specific embodiment of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

Figure 3:
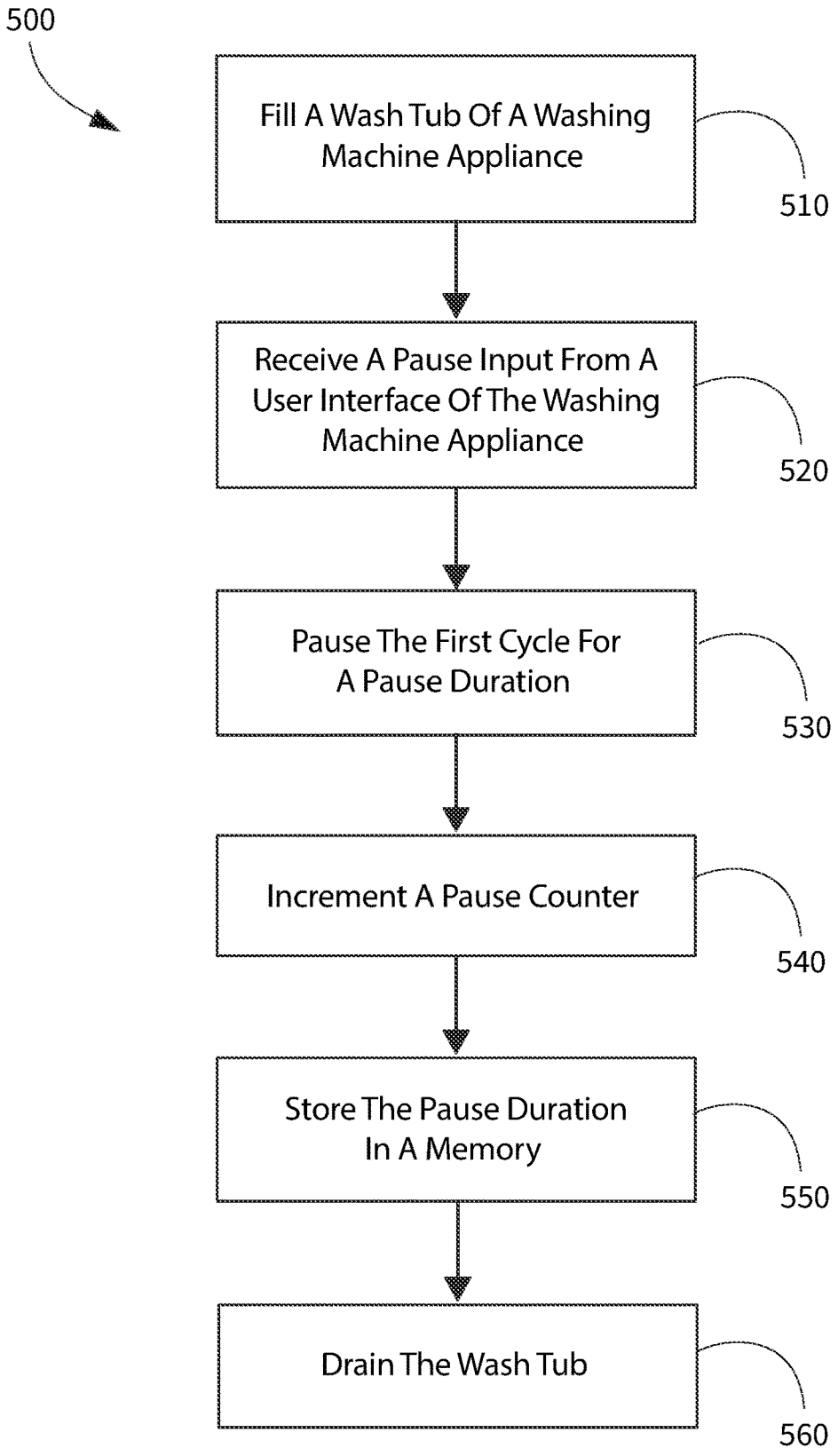
FIG. 3 illustrates an exemplary cycle of a washing machine appliance according to one or more exemplary embodiments of the present subject matter, which may be a first cycle of the washing machine appliance.

FIG. 3 illustrates an example embodiment of a cycle 500 of a washing machine appliance according to the present subject matter. Cycle 500 may be or include a wash cycle, rinse cycle, or other similar cycle of the washing machine appliance. Further, the cycle 500 may be a first cycle or an earlier cycle, e.g., which is performed prior to a second cycle or subsequent cycle, such as cycle 600 illustrated in FIG. 4 and described below. Cycle 500 can be performed by any suitable washing machine appliance, such as washing machine appliance 50 (FIG. 1). Cycle 500 may be programmed into and implemented by controller 100 (FIG. 2) of washing machine appliance 50. However, this is only by way of example, cycle 500 may also be performed by various other washing machine appliances which differ from the example washing machine appliance 50.

The washing machine appliance may include a cabinet and a wash tub mounted within the cabinet. For example, the wash tub may be configured for containing fluid, e.g., wash liquid, during operation of the washing machine appliance. As illustrated in FIG. 3, exemplary cycles of the washing machine appliance may include, and/or the washing machine appliance (such as a controller thereof) may be configured for, filling the wash tub with a wash liquid, e.g., as illustrated at step 510 in cycle 500 of FIG. 3.

As illustrated at step 520 in FIG. 3, in some embodiments, the exemplary cycle 500 may include, and/or controller 100 may be configured for, receiving a pause input from a user interface of the washing machine appliance. The user interface may be directly and physically connected to the washing machine appliance, e.g., such as the input selectors 60 illustrated in FIGS. 1 and 2, and/or the user interface may be remote, such as an app on a smartphone or other device wirelessly connected to the washing machine appliance. The pause input may be received after filling the wash tub with the wash liquid during the first cycle and before draining the wash liquid from the wash tub during the first cycle, e.g., while the wash tub contains the liquid with which the wash tub was filled in the filling step 510.

In response to the pause input, the cycle 500, which may be, e.g., a first cycle as mentioned above, is paused for a pause duration, e.g., as indicated at 530 in FIG. 3. In some embodiments, the pause duration may be predetermined, e.g., the cycle 500 may be paused in response to a pause input and the cycle 500 may then automatically resume following the predetermined pause duration after the pause input. In some embodiments, the pause input may be incremented, e.g., the cycle 500 may be paused for multiples of the predetermined pause duration in response to multiple pause inputs, wherein the pause duration that is recorded, as described below, will be the total pause duration, e.g., the multiple of the predetermined pause duration based on how many times the pause input is received. For example, the predetermined pause duration may be, e.g., five minutes, ten minutes, etc., such that when the pause input is received multiple times, e.g., three times (either successively or at any time before draining the tub), the total pause duration will be, continuing the example where three pause inputs are received, three times the predetermined pause duration, such as fifteen minutes, or thirty minutes, etc. In other embodiments, the cycle 500 may be paused in response to the pause input until a subsequent input is received, such as a resume command or an un-pause input. In such embodiments, the recorded pause duration (discussed further below) will be the total elapsed time between receiving the pause input and the resume/un-pause input.

Those of ordinary skill in the art will recognize the time period between filling the wash tub with wash liquid (e.g., at step 510) and subsequently draining the filled wash liquid from the tub (e.g., at step 560, as described below) is a soak time, e.g., during which articles within the wash tub (such as within a basket concentrically nested inside the wash tub) are submerged in, and saturated with, the wash liquid as part of a treatment (e.g., cleaning) process in the washing machine appliance. As such, the pause input during the soak time extends the soak time and thereby may be interpreted or inferred as an indication of a user desire for a longer soak time. Accordingly, as will be described in more detail below, the present disclosure includes methods of operating a washing machine appliance which provide extended soak times in response to the pause input and washing machine appliances configured to perform such methods.

As illustrated in FIG. 3, a pause counter may be incremented, e.g., at step 540. In such embodiments, the pause counter tracks the number of times a cycle has been manually paused. That is, the pause counter may track the number of time any cycle has been manually, as the pause counter is stored, e.g., in a memory of a controller of the washing machine appliance and/or remotely, such as in the cloud, and may be updated and/or accessed repeatedly numerous times over the life of the washing machine appliance to continuously track the manual pause behavior. The pause counter may also track which type of cycle is paused and how frequently, e.g., via multiple counts for various cycle types, such as incrementing a first pause counter for a first type of cycle, such as a white laundry articles cycle, and a second pause counter for a second type of cycle, such as a colors laundry articles cycle, a third pause counter for a third type of cycle, etc.

As shown at step 550 in FIG. 3, the pause duration may be stored in a memory. For example, the memory may be a memory of the washing machine appliance, e.g., of a controller of the washing machine appliance. The memory may also or instead be a memory of a remote storage device, such as a remote database or server which is accessed via the internet and/or in the cloud.

As mentioned above, the pause input may be received while the wash tub contains the liquid with which the wash tub was filled in the filling step 510, e.g., while articles within the wash tub (such as within the wash basket) are soaking. As illustrated at step 560 in FIG. 3, the cycle 500 may further include a step of draining the wash tub, e.g., of draining the liquid with which the wash tub was filled in the filling step 510 from the wash tub.

The remainder of cycle 500, e.g., first cycle, may be performed according to standard parameters and setting associated with the cycle. The first cycle 500 may then be completed. The washing machine appliance may subsequently perform another cycle after cycle 500 is completed, such as cycle 600 described below.

Figure 4:
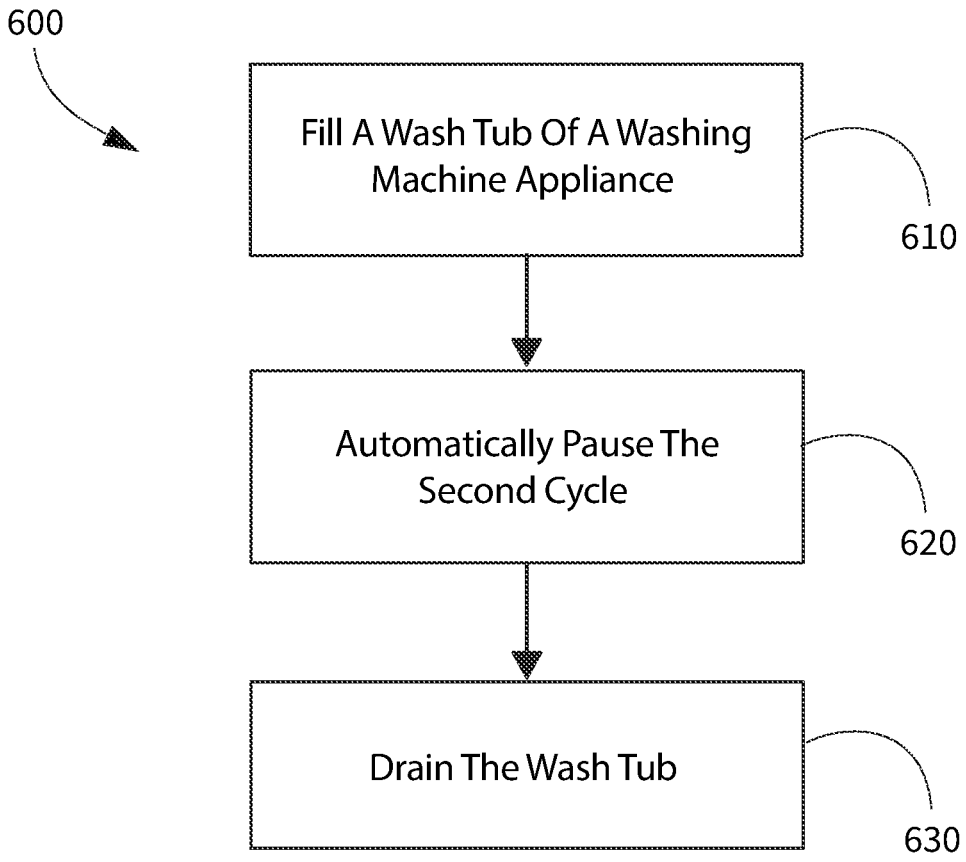
FIG. 4 illustrates another, e.g., second, exemplary cycle of the washing machine appliance according to one or more exemplary embodiments of the present subject matter.

Turning now to FIG. 4, another exemplary cycle 600 for a washing machine appliance is illustrated. As mentioned above, the cycle 600 may be a second or other subsequent cycle that is performed after the first cycle 500. Thus, an extended soak time via a built-in or automatic pause may be implemented in the cycle 600 in response to the user preference for increased soak time (which preference was indicated by the received pause input after filling the wash tub during the first cycle).

As illustrated in FIG. 4, the cycle 600 may include a step 610 of filling the wash tub with a wash liquid. Step 610 may be similar to step 510 described above. Further, step 610 may be performed after step 510, e.g., step 610 may be performed during a subsequent, e.g., second, cycle 600 of the washing machine appliance after a prior, e.g., first, cycle 500.

Cycle 600 may further include a step 620 of automatically pausing the cycle after filling the wash tub with the wash liquid and before draining the wash liquid, e.g., while articles are soaking. For example, the automatic pause may be responsive to the pause input, e.g., the automatic pause may be based on the pause counter and the stored pause duration. For example, the cycle 600 may be automatically paused based on the pause counter in that the cycle 600 is automatically paused when the pause counter is greater than a threshold value. Also by way of example, the automatic pause may be based on the pause duration in that the second cycle 600 is paused for the pause duration from the first cycle, or for a pause duration that is proportional to the pause duration from the first cycle. The threshold value may be a raw pause count, e.g., where the pause counter is X, the automatic pause may be included in subsequent cycles whenever X is greater than the threshold. In other embodiments, the threshold value may be a percentage or other proportion, e.g., the pause count may be divided by the total number of cycles performed (which may be all cycles or only cycles of a similar type) and a proportion, e.g., Y %, of cycles that are manually paused may be calculated. Further, the automatic pause may be included in subsequent cycles whenever Y % is greater than a threshold percentage value.

As another example, the pause duration of the automatic pause in the second cycle may be a default duration. In such embodiments, the default duration may be the only duration for an automatic pause, e.g., there may be a binary choice of not automatically pausing (such as when the pause counter is below a threshold) or automatically pausing for the default duration. In other embodiments, multiple default durations may be available, such as a short default, a medium default, and a long default, with tiered thresholds such that the selection of a particular one of the default durations for the automatic pause may be based on which tier the pause duration falls into.

After the soak time is completed, e.g., including an automatic pause (if any), the wash tub may then be drained at step 630, where the draining step is generally similar to that described above with respect to step 560 in the first cycle.

As mentioned above, exemplary methods of the present disclosure may be performed over a plurality of cycles of the washing machine appliance. For example, such methods may include one or more intermediate cycles between the first cycle and the second cycle. Moreover, a pause input may be received after filling the wash tub with a wash liquid during each of the one or more intermediate cycles and before draining the wash liquid from the wash tub during each of the one or more intermediate cycles. Thus, exemplary methods of operating a washing machine appliance according to the present disclosure may also include pausing each of the one or more intermediate cycles of the washing machine appliance for a respective pause duration in response to each respective pause input. In some embodiments, e.g., where the pause duration is manually controlled or otherwise varies from one cycle to the next, such methods may further include calculating an average pause duration from the pause duration of the first cycle and each respective pause duration of the one or more intermediate cycles. Thus, the subsequent, e.g., second, cycle of the washing machine appliance (which is second in name only in such embodiments when one or more intermediate cycles are also included) may be automatically paused for the average pause duration.

As mentioned above, the pause counter may also track which type of cycle is paused. For example, exemplary methods according to the present disclosure may also include recording a cycle type of the first cycle. In such embodiments, the step 620 of automatically pausing the second cycle 600 of the washing machine appliance is performed when a cycle type of the second cycle is the same as the cycle type of the first cycle. The cycle types may be defined or differentiated in various ways, such as by a selected article type, as discussed above.

As another example, the cycle types may be distinguished based on a soil level selection. In such embodiments, exemplary methods according to the present disclosure may include recording a soil level selection of the first cycle, and the step 620 of automatically pausing the second cycle 600 may be performed when a soil level selection of the second cycle is the same as the soil level selection of the first cycle.

For still another example, the cycle types may be distinguished based on a temperature selection. In such embodiments, exemplary methods according to the present disclosure may include recording a temperature selection of the wash liquid during the first cycle, and the step 620 of automatically pausing the second cycle 600 may be performed when a temperature selection for the second cycle is the same as the recorded temperature selection from the first cycle.

As a further example, the cycle types may be distinguished based on turbidity level. In this example, the turbidity level may be sensed or measured, e.g., by the washing machine appliance and/or in the cloud, in contrast to the foregoing examples where the cycle types are distinguished based on one or more user inputs or selections. In such embodiments, exemplary methods according to the present disclosure may include recording a turbidity level during the first cycle, and the step 620 of automatically pausing the second cycle 600 may be performed when a turbidity level during the second cycle is the same as the recorded turbidity level from the first cycle.

Additionally, it should be noted that the cycle types may be distinguished based on more than one of the above-described examples. For example, the cycle type may be defined based on a temperature selection, a fabric type selection, and a turbidity level. It should further be understood that various other combinations of the above-described distinguishing factors are also possible, and that all possible combinations of any two or more factors are intended to be included within the scope of the present disclosure. Moreover, any of the factors may be applied with a tolerance range, such as providing the automatic pause when the factor, e.g., temperature, turbidity, etc., of the second cycle is within a tolerance range of, such as ten percent greater or less than, the same factor in the first cycle.

In some embodiments, the method may include recording one or more conditions of the first cycle. In such embodiments, the pause counter may be a first pause counter corresponding to the one or more recorded conditions of the first cycle. When the one or more recorded conditions of the first cycle are present in the second cycle, the automatic pause may be implemented in the second cycle, in a similar manner as described above, e.g., based on the first pause counter. Further, a pause input may be received during a third cycle, which may be after the second cycle, where the one or more recorded conditions of the first cycle are not present in the third cycle. Thus, such embodiments may then further include incrementing a second pause counter in response to receiving the pause input during the third cycle in which the recorded conditions are not present. Such embodiments may further include additional pause counters reflecting further variations in the cycle conditions, such as a third pause counter, a fourth pause counter, etc.

In some embodiments, e.g., when the pause counter is greater than zero but less than an automatic pause threshold, the soak time in the subsequent, e.g., second cycle, may be extended on request. For example, the method may also include providing a prompt to add a soak time on the user interface of the washing machine appliance based on the pause counter and the stored pause duration prior to the second cycle of the washing machine appliance. As noted above, the user interface may be directly and physically connected to the washing machine appliance and/or may be a remote user interface, such as a smartphone app. In such embodiments, the second cycle of the washing machine appliance may then be automatically paused after filling the wash tub when an affirmative response to the prompt is received prior to the second wash cycle. The pause may thereby be automatically performed after the fill of the second cycle, and in such embodiments the only manual input required is the pre-cycle affirmative response to the prompt to add a soak time. Thus, the user will not need to observe the operation of the washing machine appliance or wait until the cycle has progressed to a certain point in order to have the extended soak, instead, the extended soak can be selected at the same time as other parameters or settings for the cycle, e.g., just prior to initiating the cycle.

Accordingly, embodiments of the present disclosure generally include methods of operating a washing machine appliance wherein the number of times a user pauses the washing machine appliance and the duration of the pause are recorded when the pause of the cycle occurs while the wash tub is full of wash liquid, e.g., after filling and before draining, where the fill and drain both occur during the same cycle. As mentioned, such recording may be in a local memory and/or remote, such as in the cloud. Moreover, such recording may occur when the pause duration and/or the period of time during which the tub is full of liquid is greater than a time threshold, in order to help distinguish a soak from an instance in which the cycle may be paused for a different reason. Further, conditions of the pause event may also be recorded. As mentioned above, such conditions may include, but are not limited to, which cycle was initially selected, option settings such as soil level, temperature, and/or fabric type, and/or measured conditions such as a turbidity level of the wash liquid. In addition to the storage, several steps of the present methods may be performed locally or in the cloud, such as observation, processing, and data capture, e.g., steps such as incrementing the counter, monitoring for the pause input, etc., may be performed locally, in the cloud, or both, in various combinations. Embodiments of the present disclosure also include washing machine appliances configured to perform such methods.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine appliance, the washing machine appliance comprising a cabinet and a wash tub mounted within the cabinet, the wash tub configured for containing fluid during operation of the washing machine appliance, the method comprising:

filling the wash tub with a wash liquid during a first cycle of the washing machine appliance;

receiving a pause input from a user interface of the washing machine appliance after filling the wash tub with the wash liquid during the first cycle and before draining the wash liquid from the wash tub during the first cycle;

pausing the first cycle of the washing machine appliance for a pause duration in response to the pause input;

resuming the first cycle of the washing machine at the end of the pause duration;

incrementing a pause counter in response to the pause input;

storing the pause duration after resuming the first cycle of the washing machine appliance;

filling the wash tub with a wash liquid during a second cycle of the washing machine appliance after the first cycle; and automatically pausing the second cycle of the washing machine appliance after filling the wash tub with the wash liquid during the second cycle, based on the pause counter and the stored pause duration.

2. The method of claim 1, wherein the second cycle of the washing machine appliance is automatically paused when the pause counter is greater than a threshold value.

3. The method of claim 1, wherein the second cycle of the washing machine appliance is automatically paused for a default pause duration.

4. The method of claim 1, further comprising one or more intermediate cycles between the first cycle and the second cycle, receiving a pause input after filling the wash tub with a wash liquid during each of the one or more intermediate cycles and before draining the wash liquid from the wash tub during each of the one or more intermediate cycles, pausing each of the one or more intermediate cycles of the washing machine appliance for a respective pause duration in response to each respective pause input, and calculating an average pause duration from the pause duration of the first cycle and each respective pause duration of the one or more intermediate cycles, wherein the second cycle of the washing machine appliance is automatically paused for the average pause duration.

5. The method of claim 1, further comprising recording a cycle type of the first cycle, wherein the step of automatically pausing the second cycle of the washing machine appliance is performed when a cycle type of the second cycle is the same as the cycle type of the first cycle.

6. The method of claim 1, further comprising recording a soil level selection of the first cycle, wherein the step of automatically pausing the second cycle of the washing machine appliance is performed when a soil level selection of the second cycle is the same as the soil level selection of the first cycle.

7. The method of claim 1, further comprising recording a temperature selection of the wash liquid during the first cycle, wherein the step of automatically pausing the second cycle of the washing machine appliance is performed when a temperature selection for the second cycle is the same as the recorded temperature selection from the first cycle.

8. The method of claim 1, further comprising recording a turbidity level during the first cycle, wherein the step of automatically pausing the second cycle of the washing machine appliance is performed when a turbidity level during the second cycle is the same as the recorded turbidity level from the first cycle.

9. The method of claim 1, further comprising recording one or more conditions of the first cycle, wherein the pause counter is a first pause counter corresponding to the one or more recorded conditions of the first cycle and the one or more recorded conditions of the first cycle are present in the second cycle, further comprising incrementing a second pause counter in response to receiving a pause input during a third cycle of the washing machine appliance, wherein the one or more recorded conditions of the first cycle are not present in the third cycle.

10. The method of claim 1, further comprising providing a prompt to add a soak time on the user interface of the washing machine appliance based on the pause counter and the stored pause duration prior to the second cycle of the washing machine appliance, wherein the second cycle of the washing machine appliance is automatically paused after receiving an affirmative response to the prompt.

11. A washing machine appliance comprising:

a cabinet;

a wash tub mounted within the cabinet, the wash tub configured for containing fluid during operation of the washing machine appliance; and a controller, the controller configured for:

filling the wash tub with a wash liquid during a first cycle of the washing machine appliance;

receiving a pause input from a user interface of the washing machine appliance after filling the wash tub with the wash liquid during the first cycle and before draining the wash liquid from the wash tub during the first cycle;

pausing the first cycle of the washing machine appliance for a pause duration in response to the pause input;

resuming the first cycle of the washing machine at the end of the pause duration;

incrementing a pause counter in response to the pause input;

storing the pause duration after resuming the first cycle of the washing machine appliance;

filling the wash tub with a wash liquid during a second cycle of the washing machine appliance after the first cycle; and automatically pausing the second cycle of the washing machine appliance based on the pause counter and the stored pause duration.

12. The washing machine appliance of claim 11, wherein the controller is configured for automatically pausing the second cycle of the washing machine appliance when the pause counter is greater than a threshold value.

13. The washing machine appliance of claim 11, wherein the controller is configured for automatically pausing the second cycle of the washing machine appliance for a default pause duration.

14. The washing machine appliance of claim 11, wherein the controller is further configured for performing one or more intermediate cycles between the first cycle and the second cycle, receiving a pause input after filling the wash tub with a wash liquid during each of the one or more intermediate cycles and before draining the wash liquid from the wash tub during each of the one or more intermediate cycles, pausing each of the one or more intermediate cycles of the washing machine appliance for a respective pause duration in response to each respective pause input, and calculating an average pause duration from the pause duration of the first cycle and each respective pause duration of the one or more intermediate cycles, wherein the second cycle of the washing machine appliance is automatically paused for the average pause duration.

15. The washing machine appliance of claim 11, wherein the controller is further configured for recording a cycle type of the first cycle, wherein the step of automatically pausing the second cycle of the washing machine appliance is performed when a cycle type of the second cycle is the same as the cycle type of the first cycle.

16. The washing machine appliance of claim 11, wherein the controller is further configured for recording a soil level selection of the first cycle, wherein the step of automatically pausing the second cycle of the washing machine appliance is performed when a soil level selection of the second cycle is the same as the soil level selection of the first cycle.

17. The washing machine appliance of claim 11, wherein the controller is further configured for recording a temperature selection of the wash liquid during the first cycle, wherein the step of automatically pausing the second cycle of the washing machine appliance is performed when a temperature selection for the second cycle is the same as the recorded temperature selection from the first cycle.

18. The washing machine appliance of claim 11, wherein the controller is further configured for recording a turbidity level during the first cycle, wherein the step of automatically pausing the second cycle of the washing machine appliance is performed when a turbidity level during the second cycle is the same as the recorded turbidity level from the first cycle.

19. The washing machine appliance of claim 11, wherein the controller is further configured for recording one or more conditions of the first cycle, wherein the pause counter is a first pause counter corresponding to the one or more recorded conditions of the first cycle and the one or more recorded conditions of the first cycle are present in the second cycle, further comprising incrementing a second pause counter in response to receiving a pause input during a third cycle of the washing machine appliance, wherein the one or more recorded conditions of the first cycle are not present in the third cycle.

20. The washing machine appliance of claim 11, wherein the controller is further configured for providing a prompt to add a soak time on the user interface of the washing machine appliance based on the pause counter and the stored pause duration prior to the second cycle of the washing machine appliance, wherein the second cycle of the washing machine appliance is automatically paused after receiving an affirmative response to the prompt.

* * * * *